US005730659A

United States Patent [19]

Morita

[11] Patent Number: 5,730,659

[45] Date of Patent: Mar. 24, 1998

[54] GOLF STANCE CORRECTING DEVICE

[76] Inventor: Teruo Morita, 2-A1-105, Furuedai 5-chome, Suita-shi, Osaka, Japan

[21] Appl. No.: 783,833

[22] Filed: Jan. 13, 1997

[30] Foreign Application Priority Data

Mar. 15, 1996 [JP] Japan ..... 8-059728
Sep. 24, 1996 [JP] Japan ..... 8-251781

[51] Int. Cl.[6] ..... A63B 69/36

[52] U.S. Cl. ..... 473/218; 473/272; 473/273

[58] Field of Search ..... 473/218, 257, 473/272, 273

[56] References Cited

U.S. PATENT DOCUMENTS 2,652,251 9/1953 Molinar ..... 473/218
5,398,937 3/1995 Regan ..... 473/257
5,482,284 1/1996 Vandever ..... 473/218

*Primary Examiner*—George J. Marlo
*Attorney, Agent, or Firm*—Morrison Law Firm

[57] ABSTRACT

A golf stance correcting device includes a ball flying direction indicator, a ball positioning indicator pivotedly joined with the direction indicator, and a setting mechanism provided on the joined portion of the indicators. The mechanism allows the positioning indicator to rotate with respect to the direction indicator between a position wherein the positioning indicator crosses the direction indicator at right angles and a position wherein the positioning indicator longitudinally fits within the direction indicator. The mechanism includes rivets provided on the direction indicator and selectively associated grooves provided on the positioning indicator. Selective fitting of rivets and grooves makes the indicators cross at right angles or fit longitudinally each other. The mechanism may include a pivotal screw and protrusions on a lower surface of the positioning indicator, which fit into dents on the direction indicator. The mechanism may alternately include an elastic coupler. The elastic coupler may include setting grooves, disposed at an angle of about 45 degrees from a central shaft hole, and curved sliding routes between said grooves. The elastic coupler may alternately include setting grooves, disposed in a longitudinal and lateral direction from a central shaft hole, and curved sliding routes between said grooves.

13 Claims, 23 Drawing Sheets

GOLF STANCE CORRECTING DEVICE

BACKGROUND OF THE INVENTION

The present invention relates to a correcting device of stance at addressing a ball in golf swing.

When addressing a golf ball, even if a golfer thinks that he is getting in his correct golf stance with regard to a ball flying direction, he is actually often in a wrong stance. A beginner is especially more likely to be unconscious of an incorrect stance.

There are several known golf stance correcting devices for use in practicing. They include, for example, one with a ball flying direction indicator and a ball positioning indicator fixed orthogonally, and another to be assembled orthogonally with a ball flying indicator and a ball positioning indicator when it becomes necessary. Devices of the latter type are shown in FIGS. 25 and 26. The device of FIG. 25 has two indicators in the length of about a chopstick i.e. approximately one foot. One indicator has four projections on one face and the other indicator has four associated dents on the confronting face. The device can be assembled by putting the projections into the dents orthogonally when being used, or superposedly in the longitudinal direction when being carried or stored. The other device of FIG. 26 includes four stick members and one square metal fixture having four ports to receive the respective members. The stick members are inserted into the ports to form a golf stance correcting device having a sufficient size to ensure a correct stance when addressing a ball. Another device of this type (not shown) has a cross-shaped metal fixture, instead of the square one, and each of four extending portions thereof receives a stick member.

This kind of stance correcting device is used in practicing, for example, at a driving range or a teeing ground as follows. The ball flying direction indicator is put on a mat or ground pointing toward a pin on a putting green, and a golf ball is put on a tee immediately or in a certain distance ahead of the tip of the ball positioning indicator which is orthogonal to the ball flying direction indicator. Then, a golfer stands parallel to the ball flying direction indicator straddling the ball positioning indicator so that he can get in his correct golf stance with regard to the ball flying direction.

The known fixed-type golf stance correcting device described above is bulky and inconvenient for carrying, while the other known device to be assembled when necessary is not easy to handle because the indicators cannot be readily and quickly assembled orthogonally.

Two examples of a problematic golf stance correcting device are illustrated in FIGS. 25 and 26. The device of FIG. 25 simply including two indicators in the length of a chopstick has a convenient size for carrying or storing, but is not a suitable size for actual practicing. A golfer must place a ball down and guess an extending line of the ball positioning indicator, then take a stance along that guessed extending line. Accurate addressing is impossible with this device, and it is not practical. On the other hand, in the device of FIG. 26, the fixture and four stick members must be tied together with a string or the like when being carried and stored, and untied and assembled together in use. The device does not look attractive when the parts are exposedly tied together. Furthermore one or some of the parts are prone to be lost inadvertently. In addition, when practicing with a short club (e.g. a short iron), a golfer puts a ball immediately ahead of the tip of the ball positioning indicator. This may cause him to mistakenly hit the tip of the indicator causing the ball positioning indicator to be dangerously hit away. On the other hand, when practicing with a long club (e.g. a long iron or a driver), he puts a ball on a visualized extending line. It is not easy to put a ball at a correct position by visualizing an extended line.

OBJECTS AND SUMMARY OF THE INVENTION

It is hence an object of the present invention to provide a golf stance correcting device which is not bulky when carrying or storing, quickly assembled with two indicators in an orthogonal state, good in appearance, and easy to use.

It is a further object of the present invention to provide a golf stance correcting device which is safe when practicing with a short club and allows a golf ball to be put in a correct position when practicing with a long club.

In order to achieve these objects, the golf stance correcting device of the present invention includes a ball flying direction indicator 1 (hereinafter referred to as the direction indicator) and a ball positioning indicator 2 (hereinafter referred to as the positioning indicator) pivotally joined with the direction indicator 1. An orthogonal setting mechanism 3 is provided at the pivotally joining position of the indicators 1 and 2.

The setting mechanism 3 makes the two indicators 1 and 2 cross at right angles by fitting a convex part into a concave part of the two indicators 1 and 2. Hereinafter this fitting is called a convex-concave fitting.

The golf stance correcting device of the present invention further includes slits 24 on both sides of the direction indicator 1 through which the positioning indicator 2 is pivotedly received between an upper plate 1*d* and a lower plate 1*e* of the direction indicator 1.

The setting mechanism 3 includes a coupling member 9 made of elastic synthetic resin provided in a middle portion of the positioning indicator 2. The mechanism 3 allows the positioning indicator 2 to rotate by 90 degrees about a shaft hole 9*a* with respect to the direction indicator 1. With a shaft 10*a* of a rivet 10 being fitted into a fitting hole 8*a*, 9*b* or 8*b*, 9*c*, the positioning indicator 2 is alternately in a position wherein it is longitudinally matching with the direction indicator 1 or a position wherein it is orthogonally with it.

The golf stance correcting device of the present invention further includes an extendable ball position indicating needle 17 at the tip of the positioning indicator 2. This needle 17 is made of flexible material, and adjustably drawn out from a tip of the indicator 2 to a desired length.

Furthermore, the golf stance correcting device of the present invention has an arrow 15 at a tip of the direction indicator 1 and a setting hole 16 at a rear end of it.

The above and other objects, features and advantages of the present invention will become apparent from the following description in conjunction with the accompanying drawings.

DETAILED DESCRIPTION OF THE PREFERRED EMBODIMENTS

The golf stance correcting device of the present invention includes a ball flying direction indicator 1 and a ball positioning indicator 2 pivotedly joined with the direction indicator 1. The pivotedly joined portion is provided with a setting mechanism 3 which makes and holds the two indicators cross at right angles. Both of the indicators 1, 2 are long stick-like members, but in general the direction indicator 1 is longer than the positioning indicator 2.

In the first embodiment, the positioning indicator 2 is designed to be longitudinally superimposed on the direction indicator 1. On the other hand in the second and the third embodiment, the positioning indicator 2 is designed to be snugly received longitudinally between an upper plate and a lower plate of the direction indicator 1.

Figure 1:
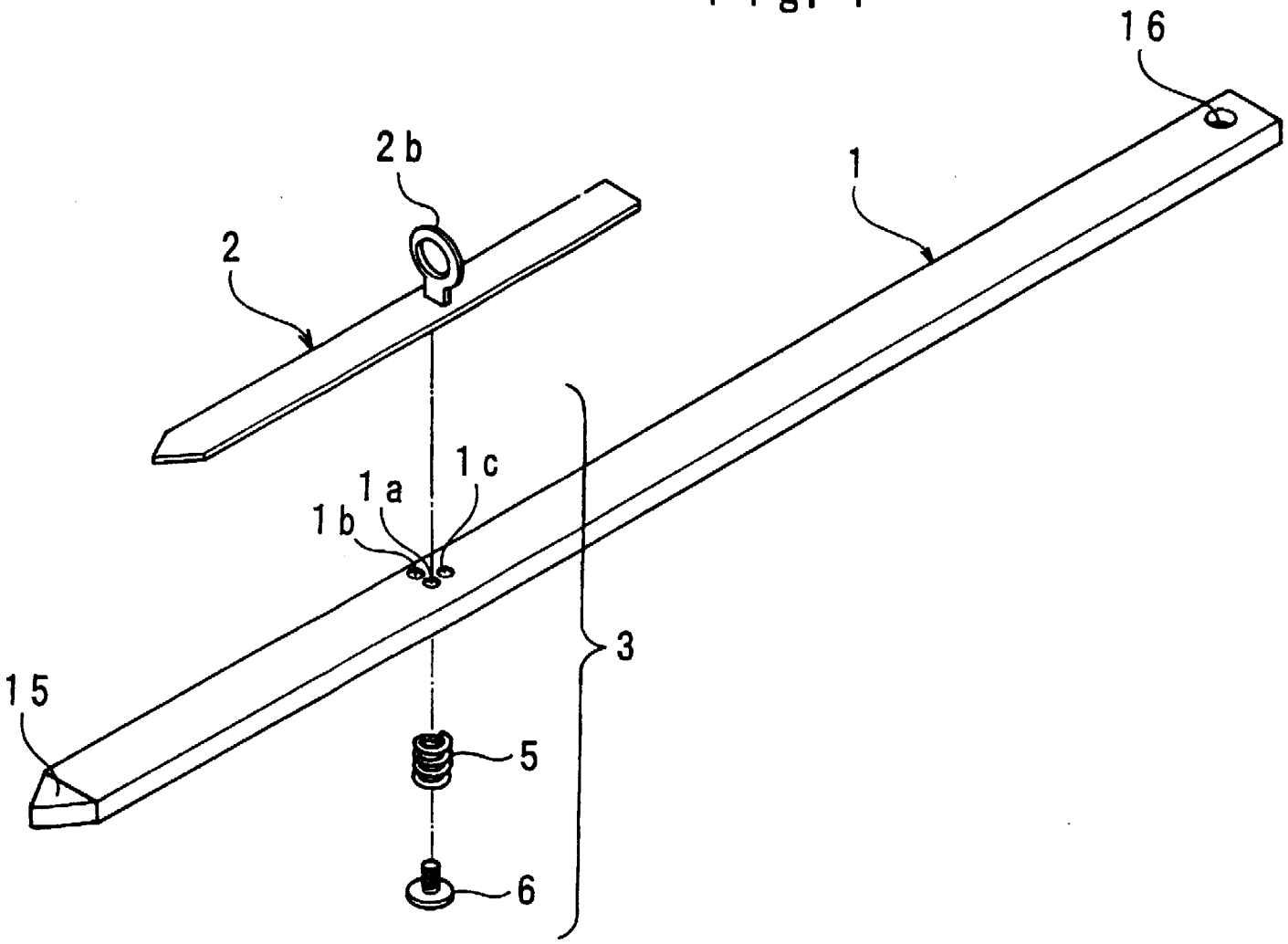
FIG. 1 is a perspective view of a first embodiment of a golf stance correcting device of the present invention, wherein the device is disassembled.
Figure 2:
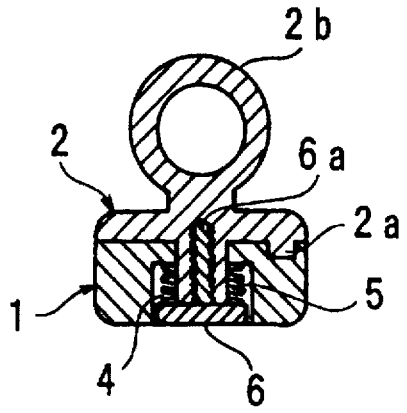
FIG. 2 is a sectional view of a pivotedly joined portion of the first embodiment of the present invention where a convex part of a positioning indicator and a concave part of a direction indicator are in a convex-concave fitting.
Figure 3:
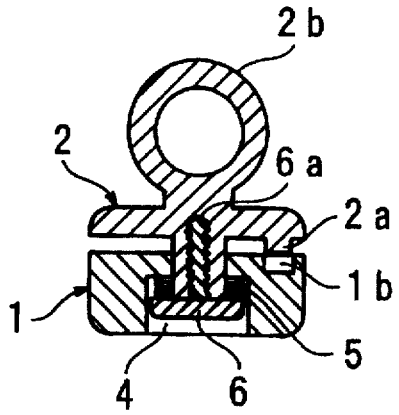
FIG. 3 is a sectional view of the joined portion where the positioning indicator of FIG. 2 is pulled up.

The first embodiment of the golf stance correcting device of the present invention is illustrated in FIG. 1 to FIG. 3. Both of the indicators 1, 2 are made of metal or plastic in the form of a solid or hollow plate. They are pivoted slidably on each other between the upper face of the direction indicator 1 and the lower face of the positioning indicator 2. The pivoted portion is provided with a setting mechanism 3 for holding the indicators 1 and 2 in place. Rotating the position indicator 2 with respect to the direction indicator 1, about the pivoted portion of setting mechanism 3, allows the indicators 1 and 2 to cross at right angles. The setting mechanism 3 includes a screw 6 having a shaft 6*a*, which is provided in a recess 4 on the lower face of the direction indicator 1, affected with repulsive force of a coil spring 5 also provided in the recess 4 and screwed in a protruding part of the positioning indicator 2 inserted in a shaft hole 1*a* of the direction indicator 1. The positioning indicator 2 has a protrusion 2*a* on its lower face. The direction indicator 1 has two setting holes 1*b*, 1*c* near the shaft hole 1*a*, and the holes 1*a*, 1*c* are on a longitudinal line and the holes 1*a*, 1*b* are on a lateral line orthogonal to it. The protrusion 2*a* can be selectively fitted into one of setting holes 1*b*, 1*c*. At a position wherein the protrusion 2*a* is fitted into the setting hole 1*b* disposed in the lateral direction, the positioning indicator 2 is superimposed longitudinally on the direction indicator 1, while at another position wherein the protrusion 2*a* is fitted into the setting hole 1*b* disposed in the longitudinal direction, the positioning indicator 2 crosses the direction indicator 1 at right angles.

The upper face of the positioning indicator 2 is provided with a handle 2*b*. Pulling up the handle 2*b* overcoming the repulsive force of the coil spring 5, rotating the positioning indicator 2 with respect to the direction indicator 1 and fitting the protrusion 2*a* in the setting holes 1*b* or 1*c* allows the indicators 1, 2 to easily obtain a convex-concave fitting.

The second embodiment of the golf stance correcting device of the present invention is shown in FIGS. 4 to 8. In this embodiment, the correcting device includes a direction indicator 1 formed with a flat elongated hollow plate of metal or plastic and provided with slits 24 on both longitudinal sides, and a positioning indicator 2 formed with a flat elongated plate of metal or plastic and provided with a lip groove 18. The positioning indicator 2 is received between an upper plate 1*d* and a lower plate 1*e* of the direction indicator 1 and joined pivotedly with the direction indicator 1 by means of a rivet 25. The joined portion of the indicators 1, 2 is provided with an orthogonal setting mechanism 3. The positioning indicator 2 may pivot in and out from the direction indicator 1 through the slits 24. The rotation of the positioning indicator 2 provides an orthogonal setting or a superimposed linear setting of the two indicators 1, 2.

Figure 5:
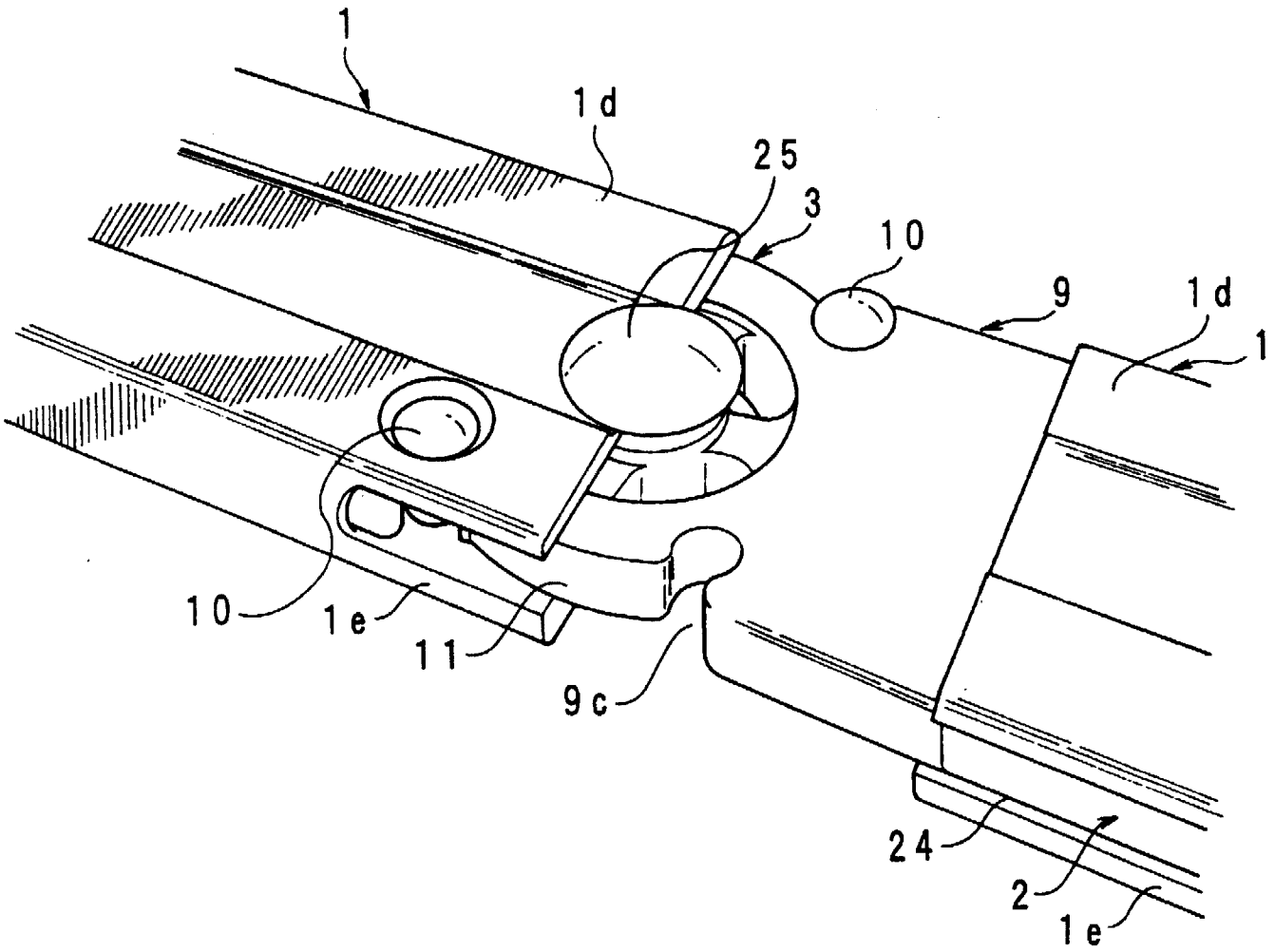
FIG. 5 is an explanatory diagram of the joined portion of the indicators of FIG. 4 with some parts being cut away.
Figure 6:
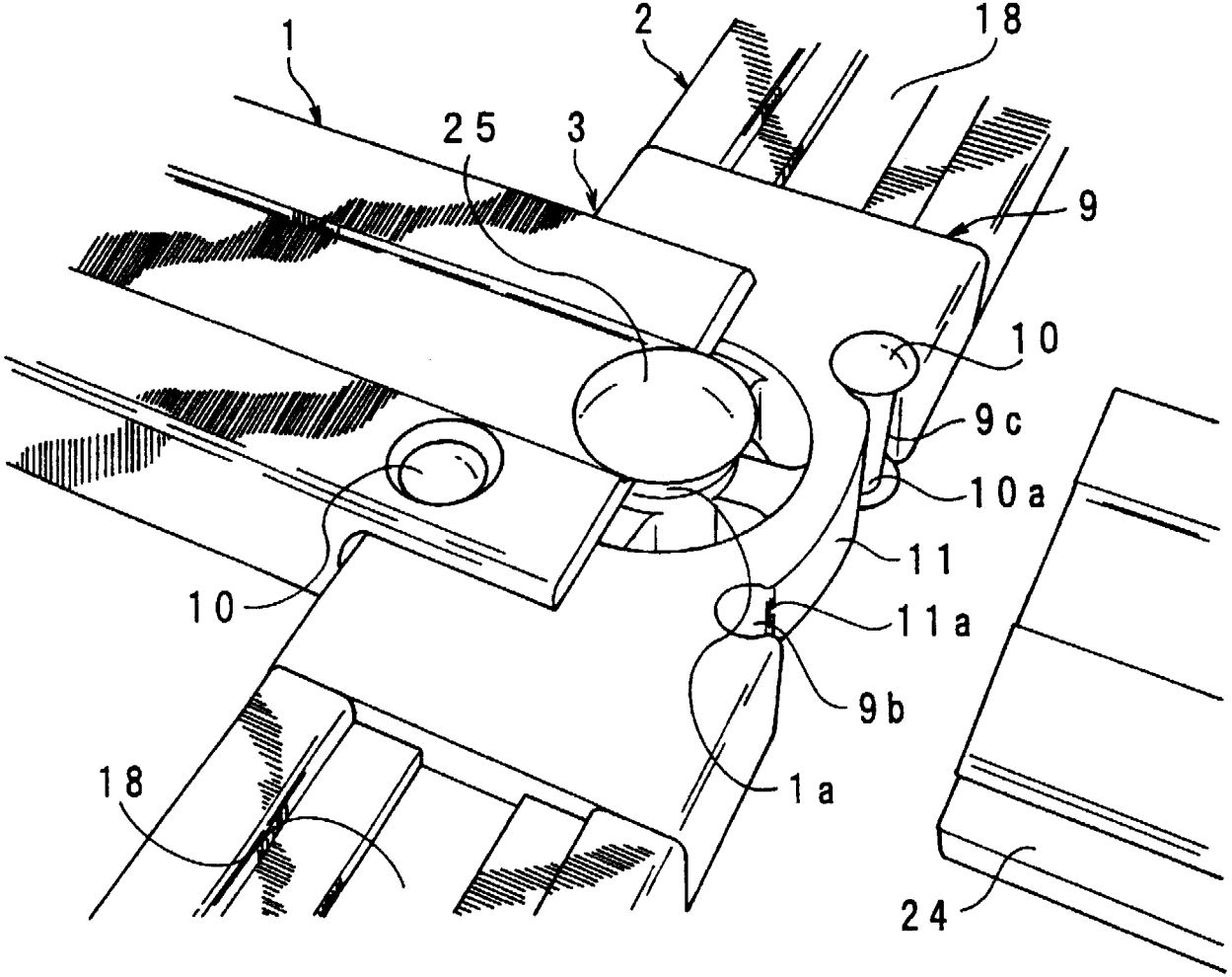
FIG. 6 is another explanatory diagram showing the joined portion of the device of the second embodiment, in which the indicators are set in an orthogonal state.
Figure 7:
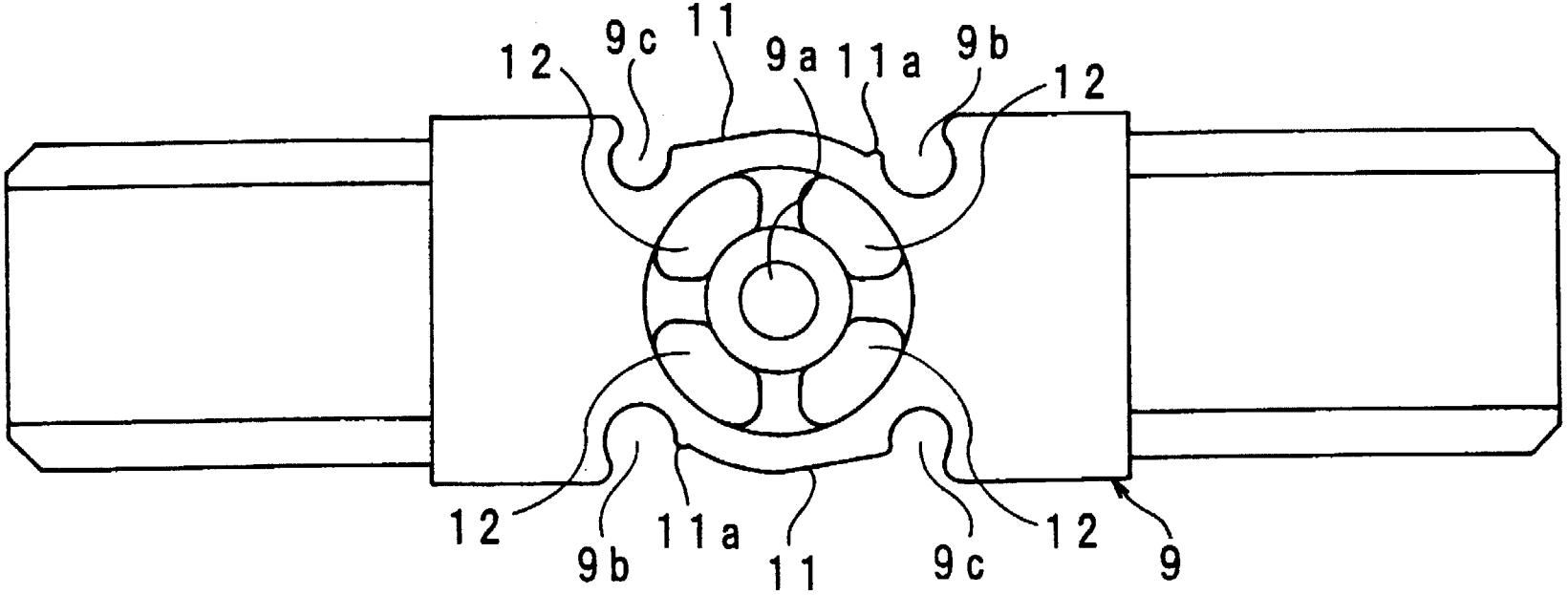
FIG. 7 is a plan view of a coupler forming a central coupling portion of the positioning indicator in the second embodiment of the present invention.
Figure 8:
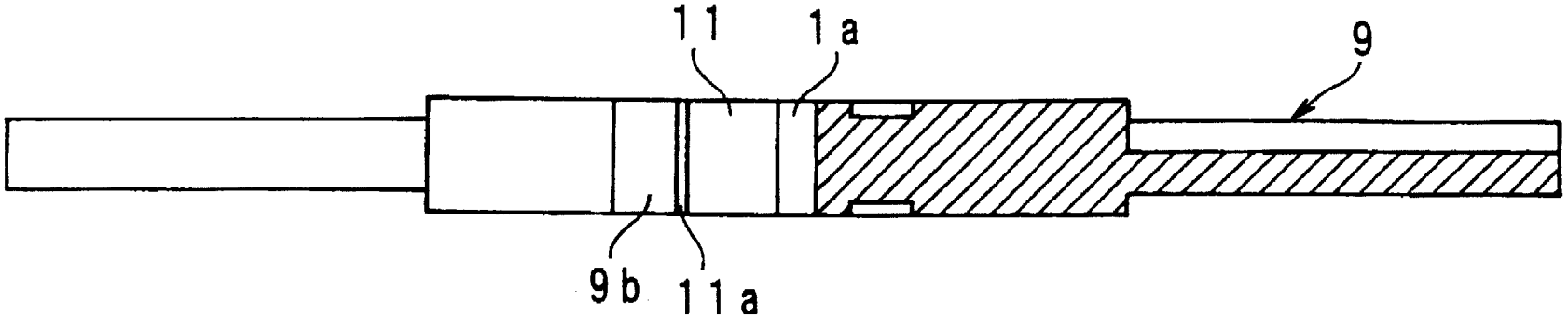
FIG. 8 is a half-sectional side view of the coupler shown in FIG. 7.

The setting mechanism 3 includes a coupler 9 of synthetic resin which forms a central coupling portion of the positioning indicator 2 and has setting grooves 9*b*, 9*c* (FIG. 7) on both sides. The grooves 9*b*, 9*c* are positioned at an angle of 45 degrees about a shaft hole 9a for the coupler 9 from both the longitudinal and lateral directions. The direction indicator 1, as shown in FIG. 6, has a rivet 25 received in a shaft hole la and two rivets 10 penetrating and fixed in the upper and lower plates 1d, 1e. The rivets 10 are provided on a diagonal line at a 45-degree angle about the shaft hole 1a from both the longitudinal and lateral directions. The shafts 10a of the rivets 10 are received in selectively either of the setting grooves 9b or 9c and get into a convex-concave fitting state (FIG. 5, 6). When the shafts 10a fit into the setting grooves 9b, the positioning indicator 2 is longitudinally received between the upper plate 1d and the lower plate 1e of the direction indicator 1 (FIG. 5). On the other hand, when the shafts 10a fit into the setting grooves 9c, the direction and positioning indicators 1, 2 cross each other at right angles (FIG. 6).

A curved sliding route 11 is formed between the setting grooves 9b and 9c on both sides of the coupler 9, which facilitates reciprocating slide of the shaft 10a between the grooves 9b, 9c. Making the curvature of the curved route 11 on the side of the groove 9b, which leads the indicators 1, 2 to a longitudinally superimposed state, larger than that on the side of the groove 9c, which leads the indicators 1, 2 to an orthogonal state, improves the rotation of the positioning indicator 2 into an orthogonal state. The structure of coupler 9 with sliding route 11, allows the indicators 1,2 to be quickly set into an orthogonal state. The boundary of the sliding route 11 and the setting groove 9b is provided with a protrusion 11a so as to prevent the shaft 10a from inadvertently removing from the setting groove 9b. Space 12 between the shaft hole 9a and each of the setting grooves 9b, 9c provides a moderate resilience and facilitates the slide of the shafts 10a.

The third embodiment of the golf stance correcting device of the present invention is shown in FIGS. 9 to 12. The correcting device of the third embodiment, like the second embodiment, includes a direction indicator 1, a positioning indicator 2, and an orthogonal setting mechanism 3. However, the structure of the setting mechanism of the third embodiment is different from that of the second embodiment.

Figure 9:
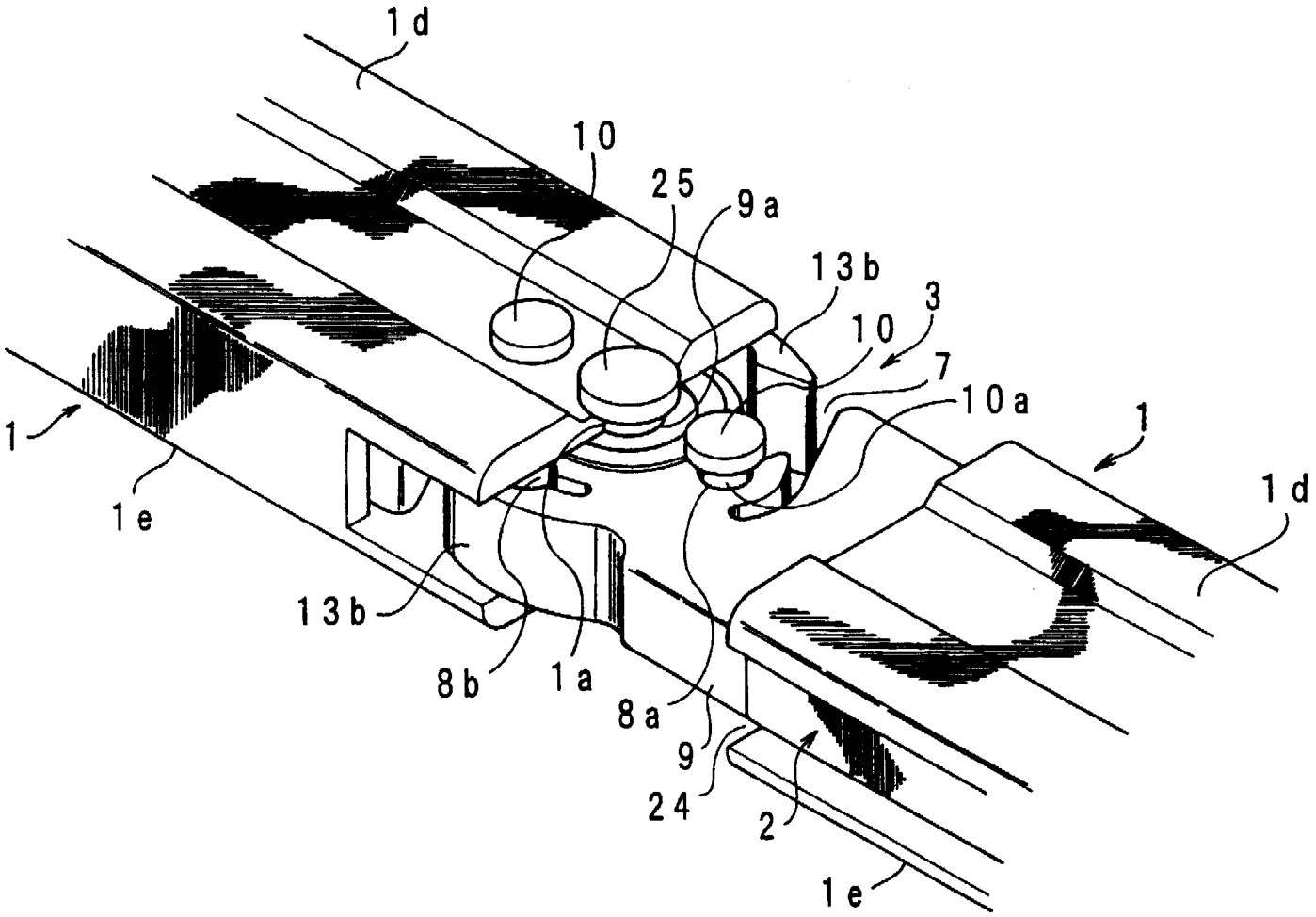
FIG. 9 is an explanatory diagram of the joined portion of the indicators of a third embodiment of the present invention with some part being cut away, in which the direction indicator longitudinally receives the positioning indicator.
Figure 10:
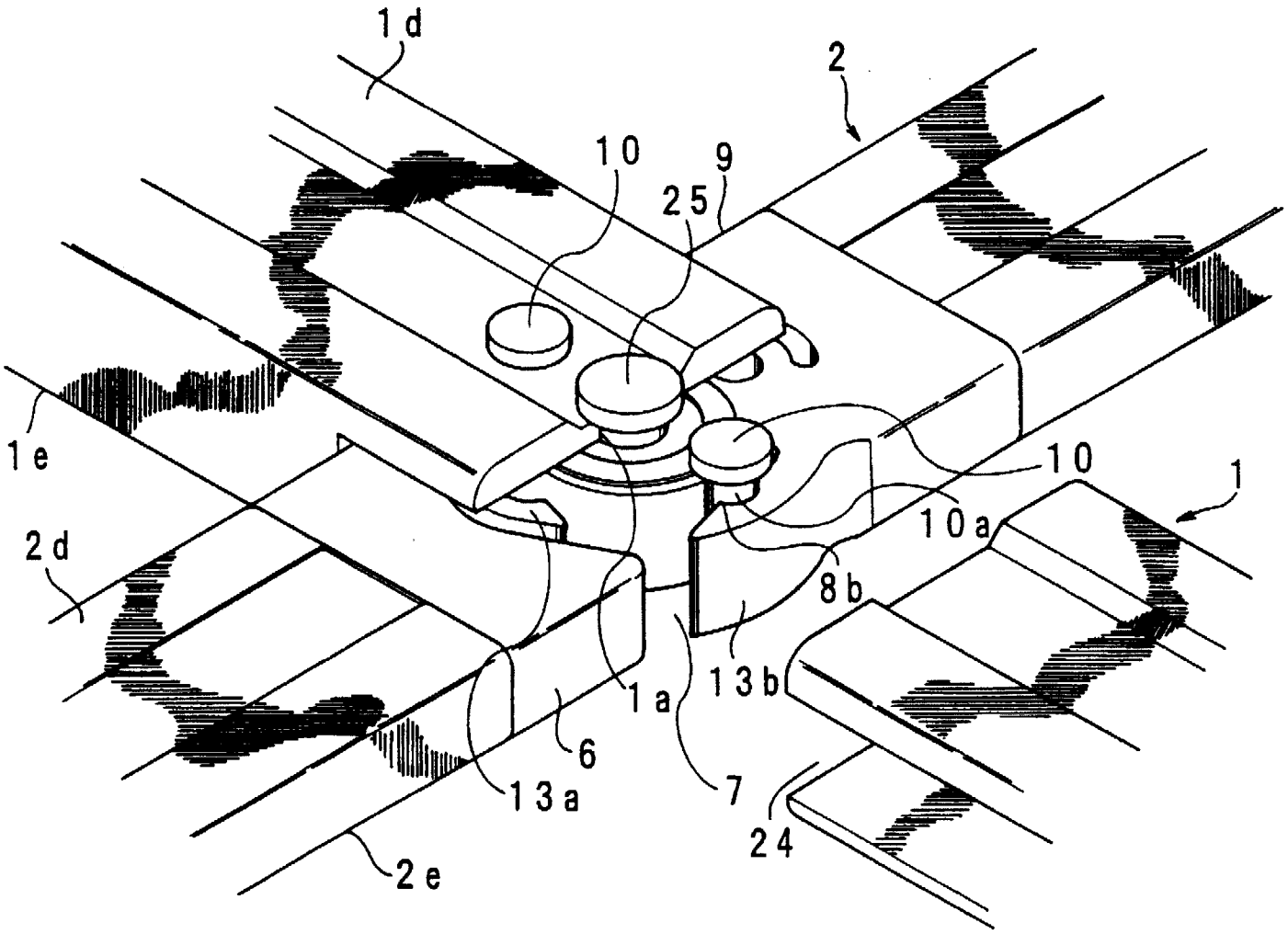
FIG. 10 is another explanatory diagram of the joined portion of the device of the third embodiment, in which the indicators cross at right angles.
Figure 11:
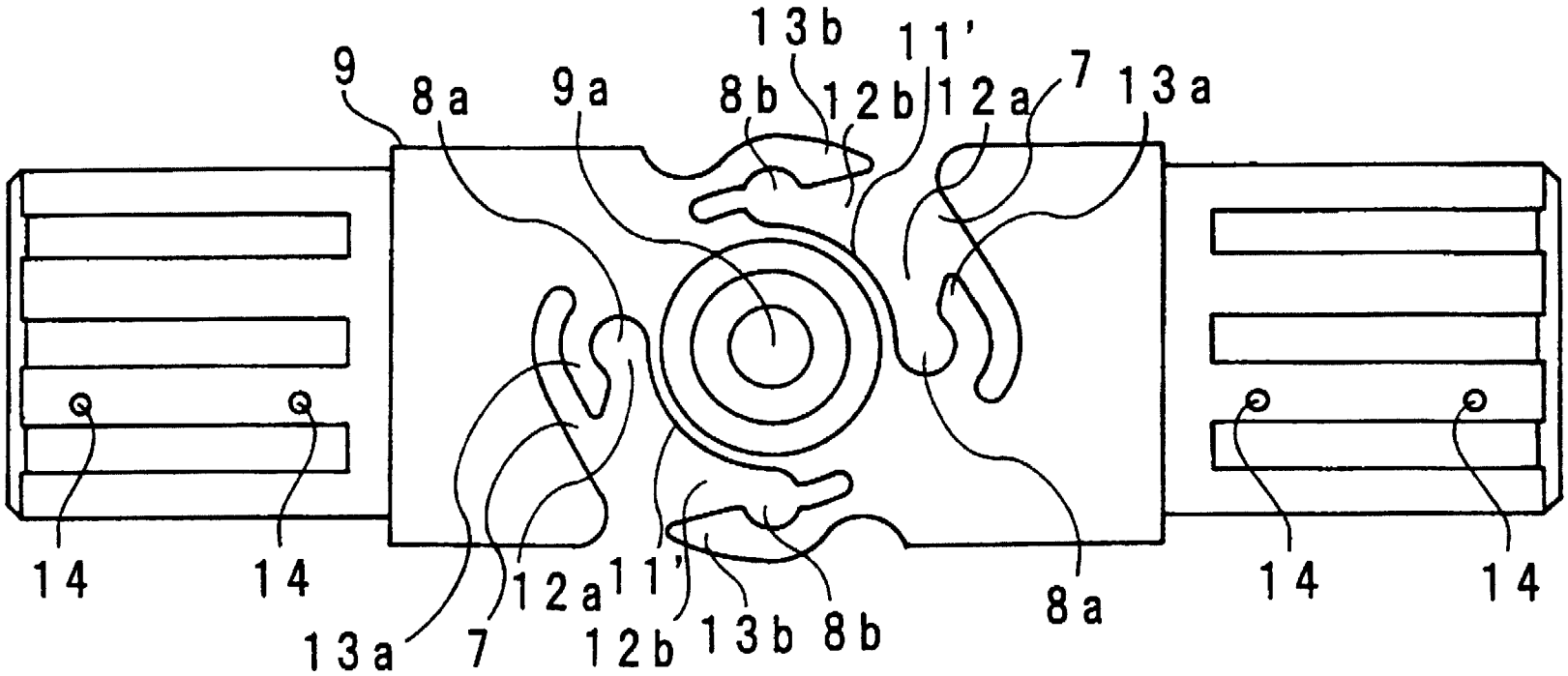
FIG. 11 is a plan view of a coupler forming a central coupling portion of the positioning indicator in the third embodiment of the present invention.
Figure 12:
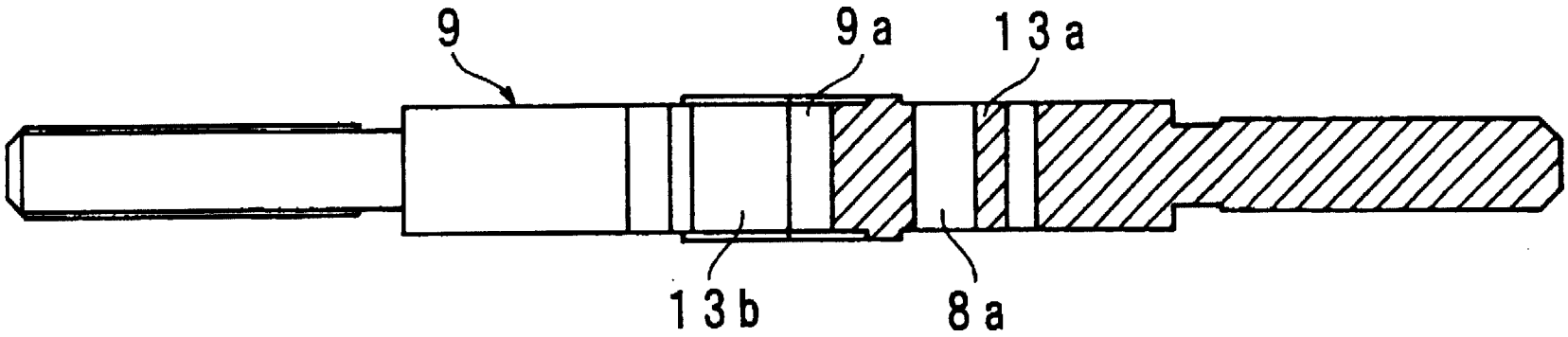
FIG. 12 is a half-sectional side view of the coupler shown in FIG. 11.

As shown in the drawings, the setting mechanism 3 includes a coupler 9 of synthetic resin which forms a central coupling portion of the positioning indicator 2 and has fitting grooves 8a, 8b (FIG. 11) in the longitudinal and lateral directions from a shaft hole 9a. The fitting grooves 8a, 8b are provided in an indentation 7 of the coupler 9. Two rivets 10, penetratingly fixed in an upper and lower plates 1d, 1e of the direction indicator 1, are disposed in the longitudinal direction, and between the two rivets 10 the shaft hole 1a is provided. The shafts 10a of the rivets 10 are selectively received within one of the fitting grooves 8a, 8b and get into a convex-concave fitting state (FIGS. 9, 10). At a position wherein the shafts 10a of the rivets 10 are fitted in the fitting groove 8a, the positioning indicator 2 is longitudinally received between the upper plate 1d and lower plate 1e of the direction indicator 1, while at a position wherein the shafts 10a are fitted in the groove 8b, the indicators 1 and 2 cross each other at right angles.

The coupler 9 is affixed to the positioning indicator 2 by putting screws (not shown) into screw holes 14 (shown in FIG. 11) provided on both end parts of the coupler 9 through screw holes (not shown) provided in either the upper plate 2d or the lower plate 2e of the positioning indicator 2.

The fitting grooves 8a and 8b are respectively provided with ports 12a, 12b of which width is smaller than the diameter of the shaft 10a of the rivet 10. The grooves 8a, 8b are partly defined by elastic pressing pieces 13a, 13b. The rivets 10a may pressingly open the ports 12a, 12b wider to fit into the fitting grooves 8a, 8b. It is preferable to give a stronger elastic force to the elastic pressing piece 13b partly defining the groove 8b in the lateral direction (the groove 8b leads to a superimposed linear state) than the piece 13a partly defining the groove 8a in the longitudinal direction (the groove 8a leads to an orthogonal state) in order to maintain an orthogonal state of the indicators 1, 2 more securely than a superimposed linear state.

Moreover, between the fitting grooves 8a and 8b in the indentation 7, an arc-form sliding route 11' is provided so as to facilitate reciprocating slide of the shaft 10a.

In the second and third embodiments of the golf stance correcting device of the present invention, the positioning indicator 2 has an extendable ball position indicating needle 17 at its tip side end. This needle 17 can be drawn out from the tip of the positioning indicator 2 and adjustable to a desired length according to a golf club. Needle 17 is slidably inserted in a lip groove 18, 18' on the positioning indicator 2. An adjuster 19 of the needle 17 is provided on a rear end of the needle 17. It is preferable to make the needle 17 of elastic material for safe use. Such a needle 17 may be also provided in the correcting device of the first embodiment.

Figure 13:
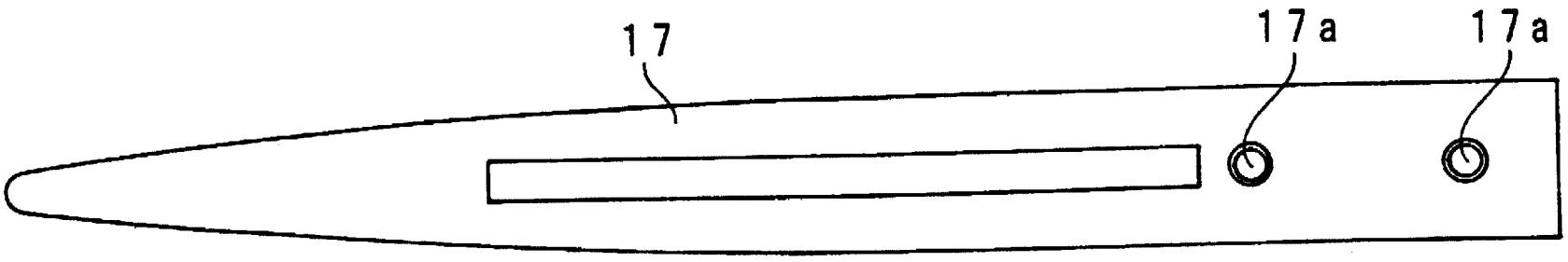
FIG. 13 is a plan view of a ball position indicating needle of the device in the second embodiment.
Figure 14:
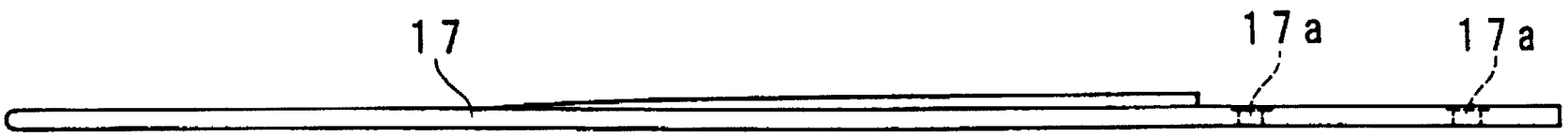
FIG. 14 is a front view of the ball position indicating needle of FIG. 13.
Figure 15:
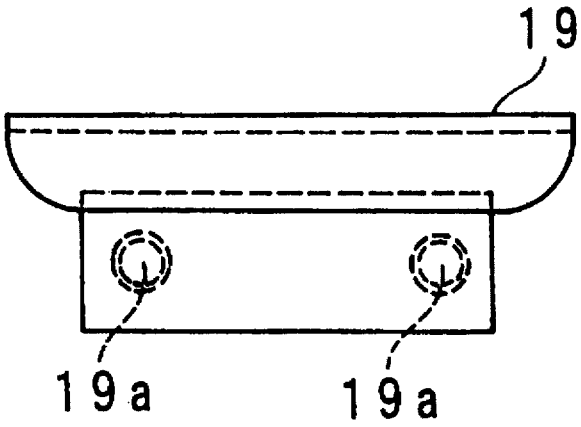
FIG. 15 is a plan view of an adjuster for the ball position indicating needle of FIG. 13.
Figure 16:
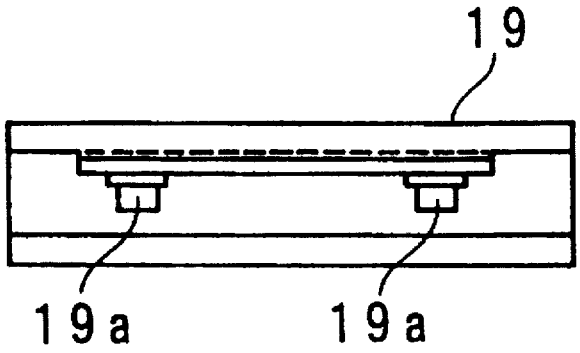
FIG. 16 is a front view of the adjuster of in FIG. 15.
Figure 17:
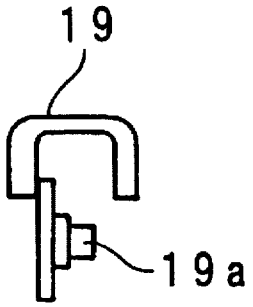
FIG. 17 is a side view of the adjuster of FIG. 15.
Figure 20:
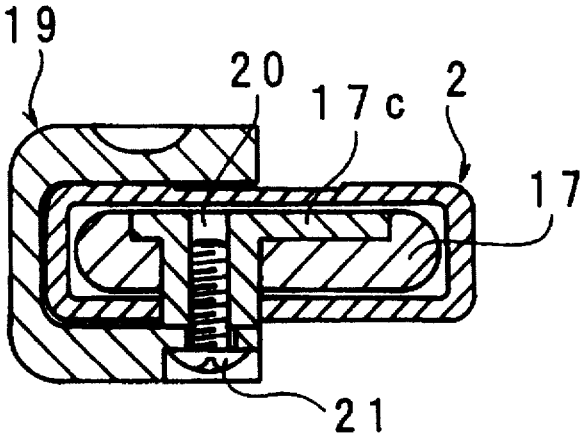
FIG. 20 is a transverse sectional view of the fitting portion of the ball position indicating needle and the positioning indicator in FIG. 18.
Figure 18:
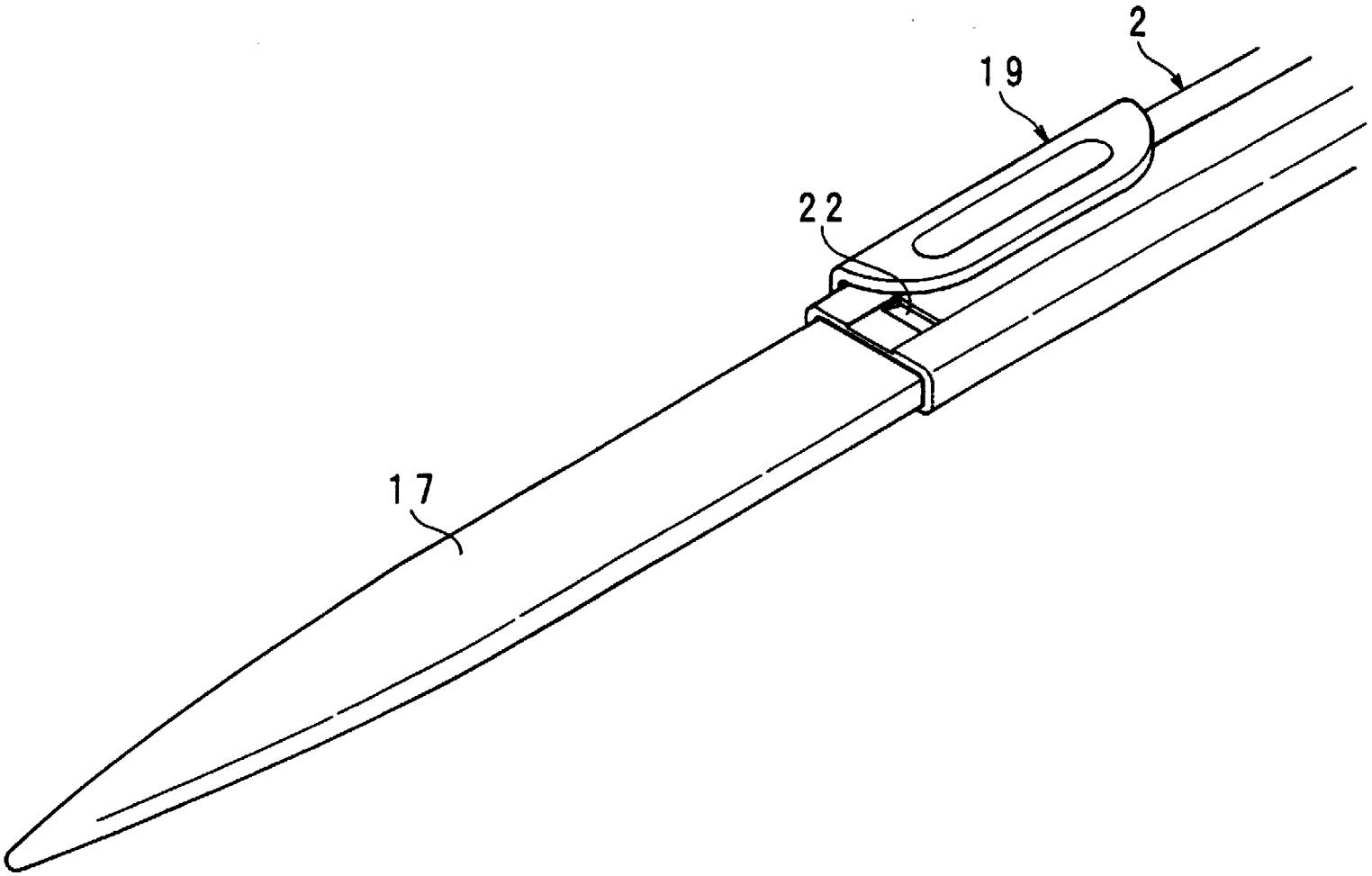
FIG. 18 is a perspective view of a ball position indicating needle of the third embodiment in which the needle is drawn out from the positioning indicator.
Figure 19:
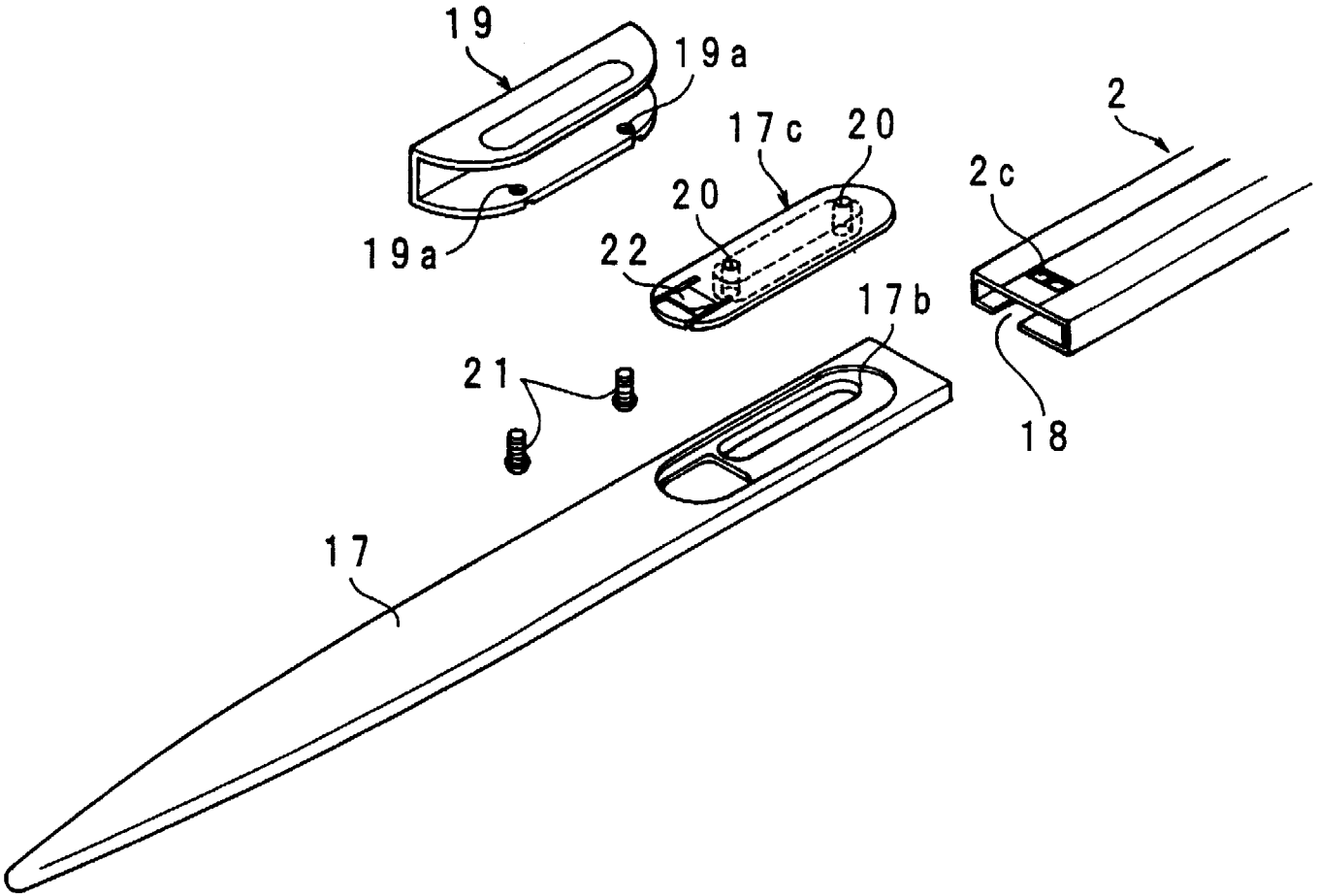
FIG. 19 is an exploded perspective view of the ball position indicating needle in FIG. 18.
Figure 21:
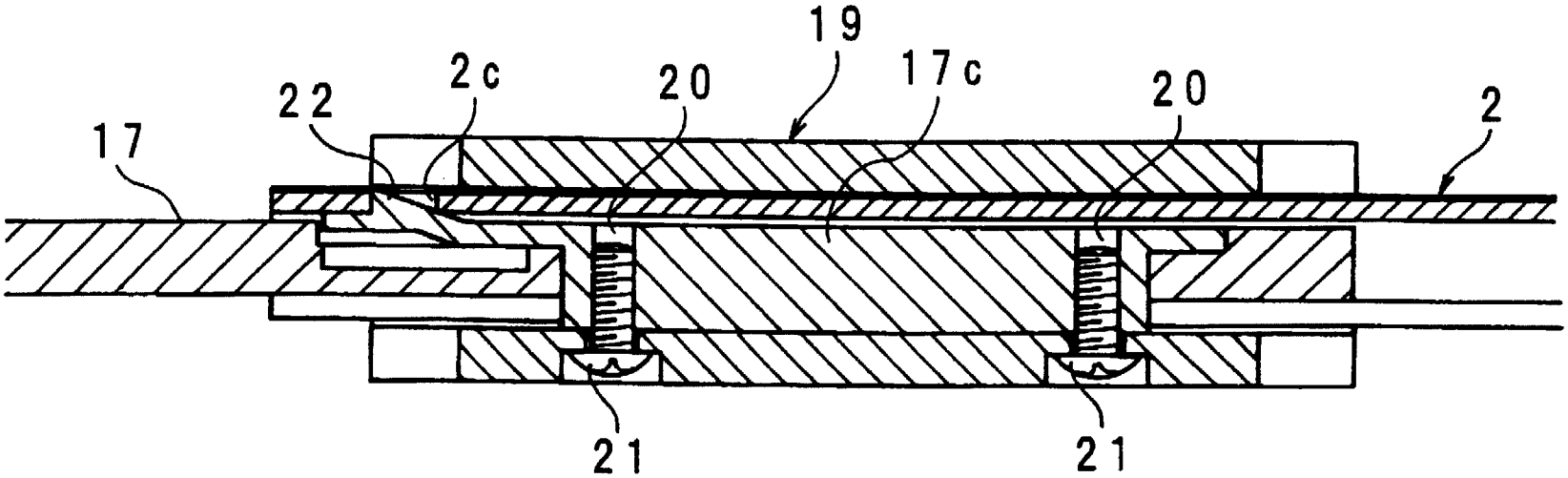
FIG. 21 is a sectional side view of the fitting portion of FIG. 20.

The ball position indicating needle 17 of the second embodiment is shown in FIGS. 13 and 14. An adjuster 19, as shown in FIGS. 15 to 17 and 23, may be provided on the positioning indicator 2 in a manner that it surrounds one side of the indicator 2 with projections 19a fitting in holes 17a of the needle 17. Another needle 17 and adjuster 19 of the third embodiment are illustrated in FIGS. 18 to 20. The needle 17 is inserted slidably into the lip groove 18' of the positioning indicator 2 and provided with an adjuster 19 at its rear end. As clearly shown in FIGS. 19 and 20, the adjuster 19 is provided so as to surround one side of the indicator 2 with screws 21 which fit through holes 19a of the adjuster 19 into holes 20 of a guide 17c provided on the rear end of the needle 17. A guide 17c may be formed integrally with the needle 17, or alternatively it may be formed separately and fitted into a recess 17b on the needle 17 as shown in FIG. 19. The guide 17c may be provided with a stopping pawl 22 at its tip side end. When the needle 17 is drawn out, the pawl 22 enters an associated stopping hole 2c on the tip side end of the positioning indicator 2 and prevents the needle 17 from slipping out of the positioning indicator 2. The needles 17 in the above two examples can be applied selectively to any one of the first, second and third embodiments.

Figure 23:
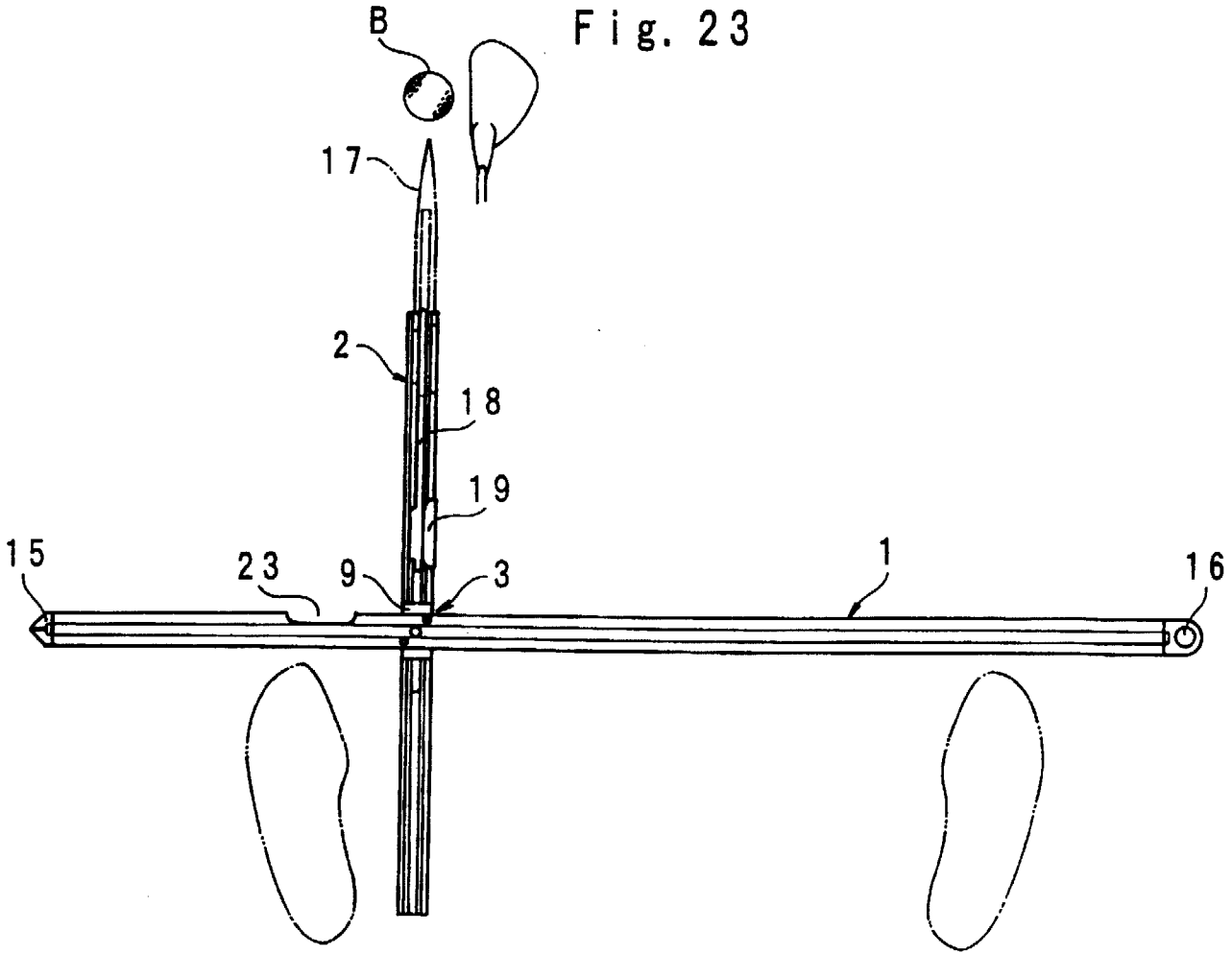
FIG. 23 is an explanatory plan view showing a practical use of the golf stance correcting device of the second embodiment.
Figure 24:
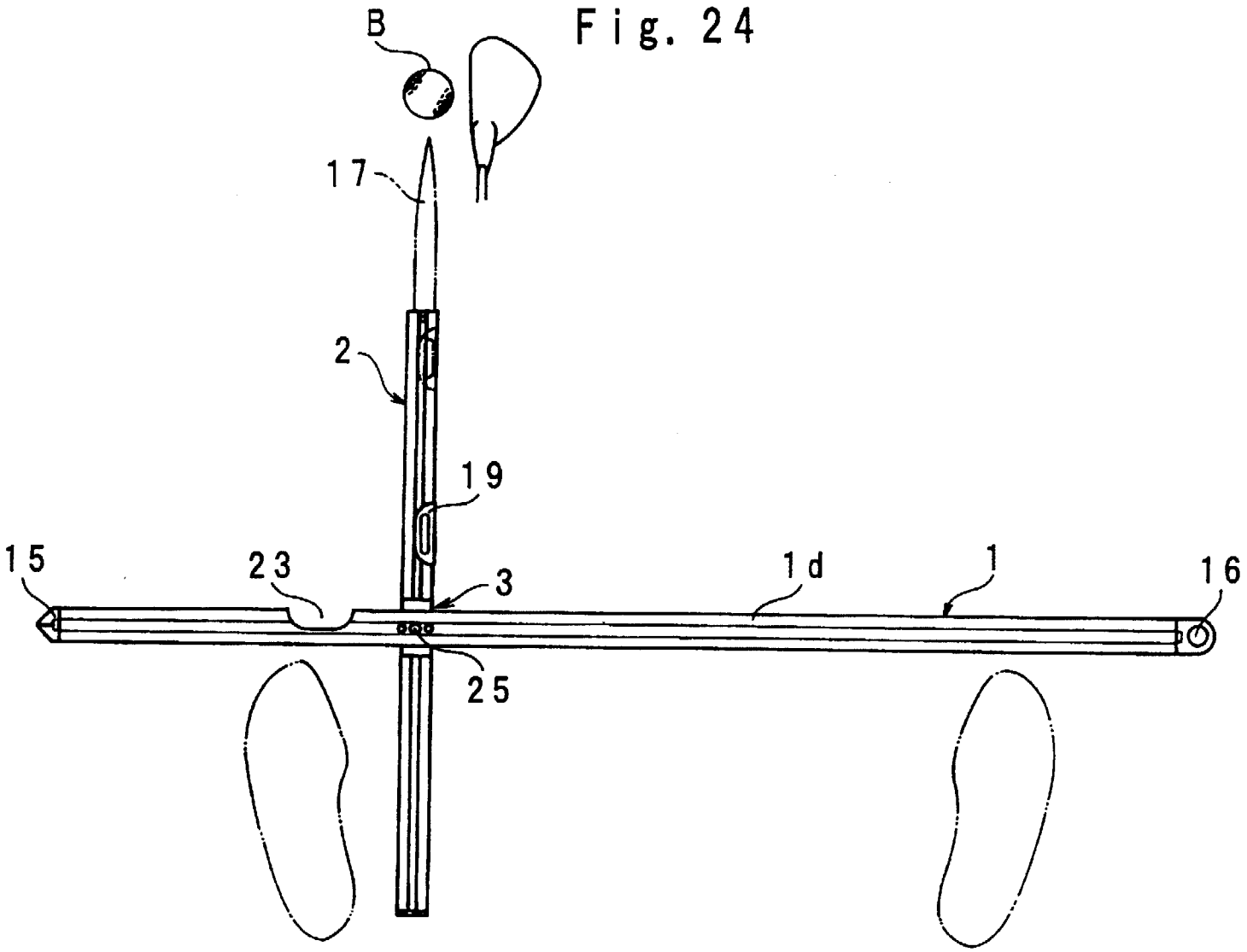
FIG. 24 is an explanatory plan view showing a practical use of the golf stance correcting device of the third embodiment.
Figure 25:
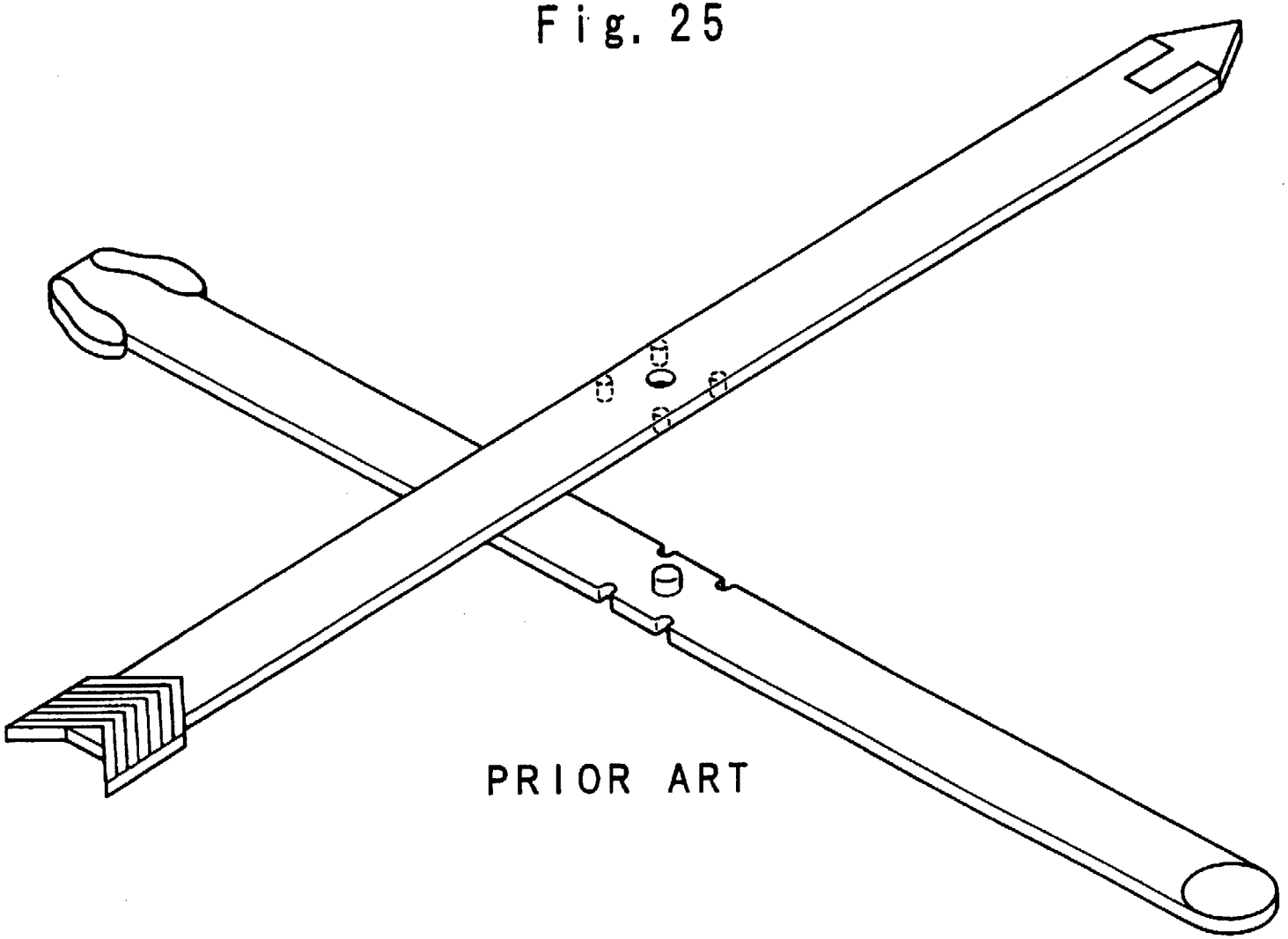
Fig. 25 PRIOR ART
FIG. 25 is a perspective view of a known device disassembled.
Figure 26:
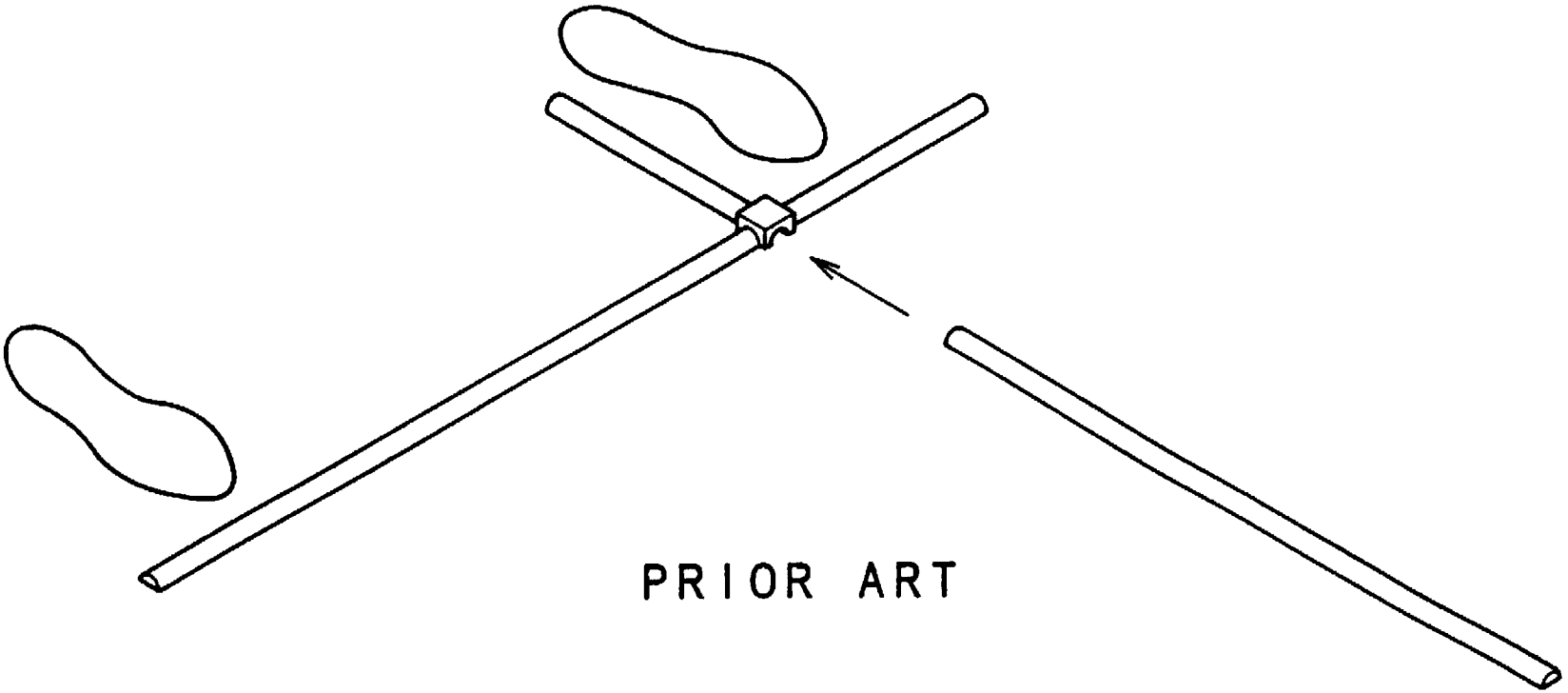
Fig. 26 PRIOR ART
FIG. 26 is an explanatory perspective view of another known device.

Referring to FIGS. 23, 24, the direction indicator 1 has an inlet 23 on one side so that the adjuster 19 may be fit into it when the positioning indicator 2 is received in the slit 24. The adjuster 19 also functions as a handhold to pull and rotate the positioning indicator 2 out from the direction indicator 1.

Figure 22:
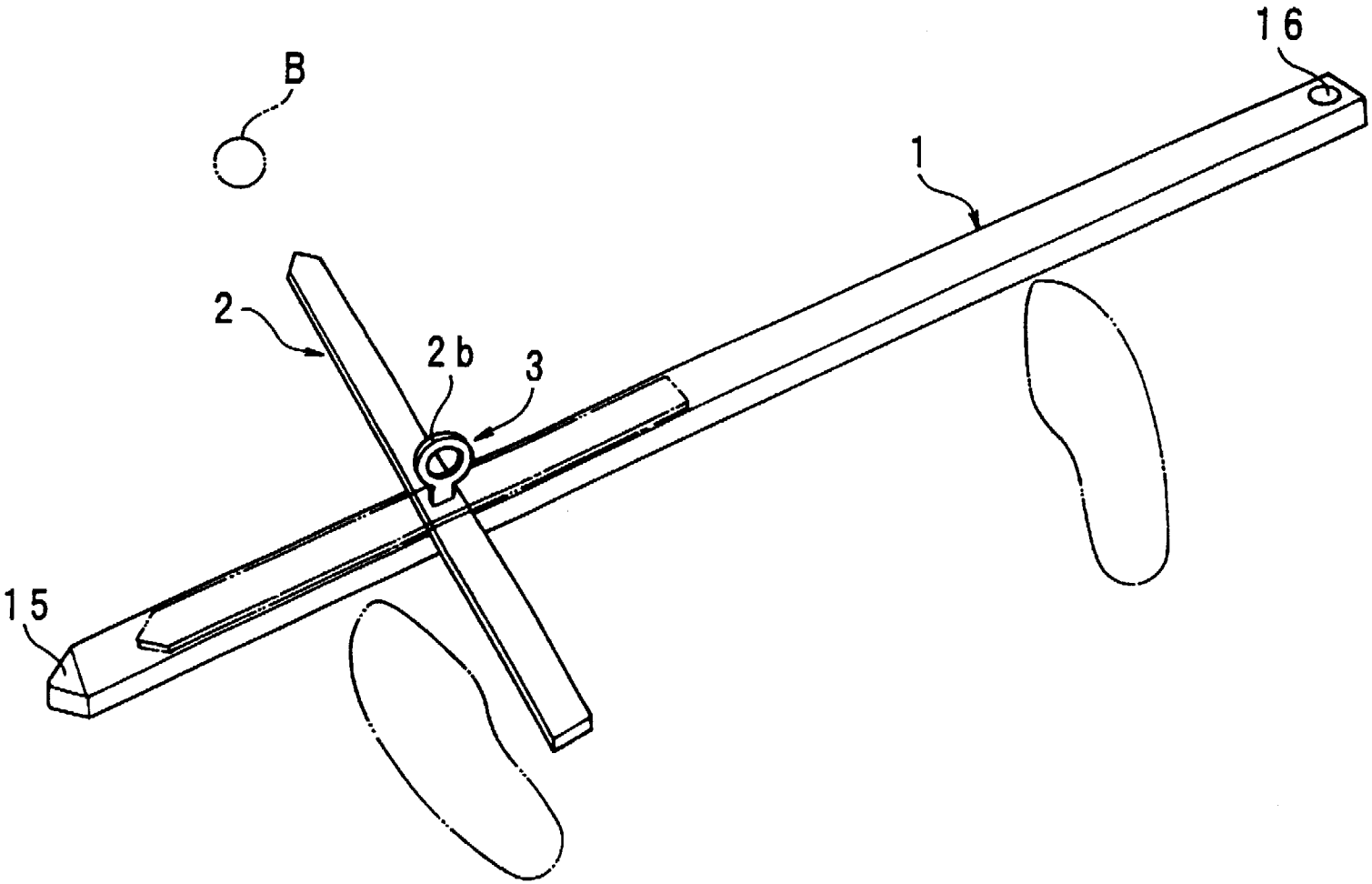
FIG. 22 is an explanatory perspective view showing a practical use of the golf stance correcting device of the first embodiment of the present invention.

The golf stance correcting device of the present invention may further include an arrow 15 at the tip of the direction indicator 1, and a setting hole 16 on the rear end of the indicator 1. The device may be held in place by sticking a tee into the ground through the setting hole 16. The arrow 15 and the hole 16 may be formed by shaping and holing the direction indicator 1 as shown in FIGS. 1 and 22 (the first embodiment), or attaching a separate member with an arrow to the tip and another with a hole to the rear end of the direction indicator 1 as shown in FIGS. 4, 23, 24 (the second and third embodiments).

The golf stance correcting device of the invention is used as follows.

As to the golf stance correcting device of the first embodiment, referring to FIGS. 2, 3, the handle 2*b* is pulled up to release a convex-concave fitting between the protrusion 2*a* and the setting hole 1*b*, the positioning indicator 2 is rotated 90 degrees, and at that position the protrusion 2*a* is put down into the setting hole 1*c* to obtain another convex-concave fitting, so that the direction indicator 1 and positioning indicator 2 come to cross at right angles.

Figure 4:
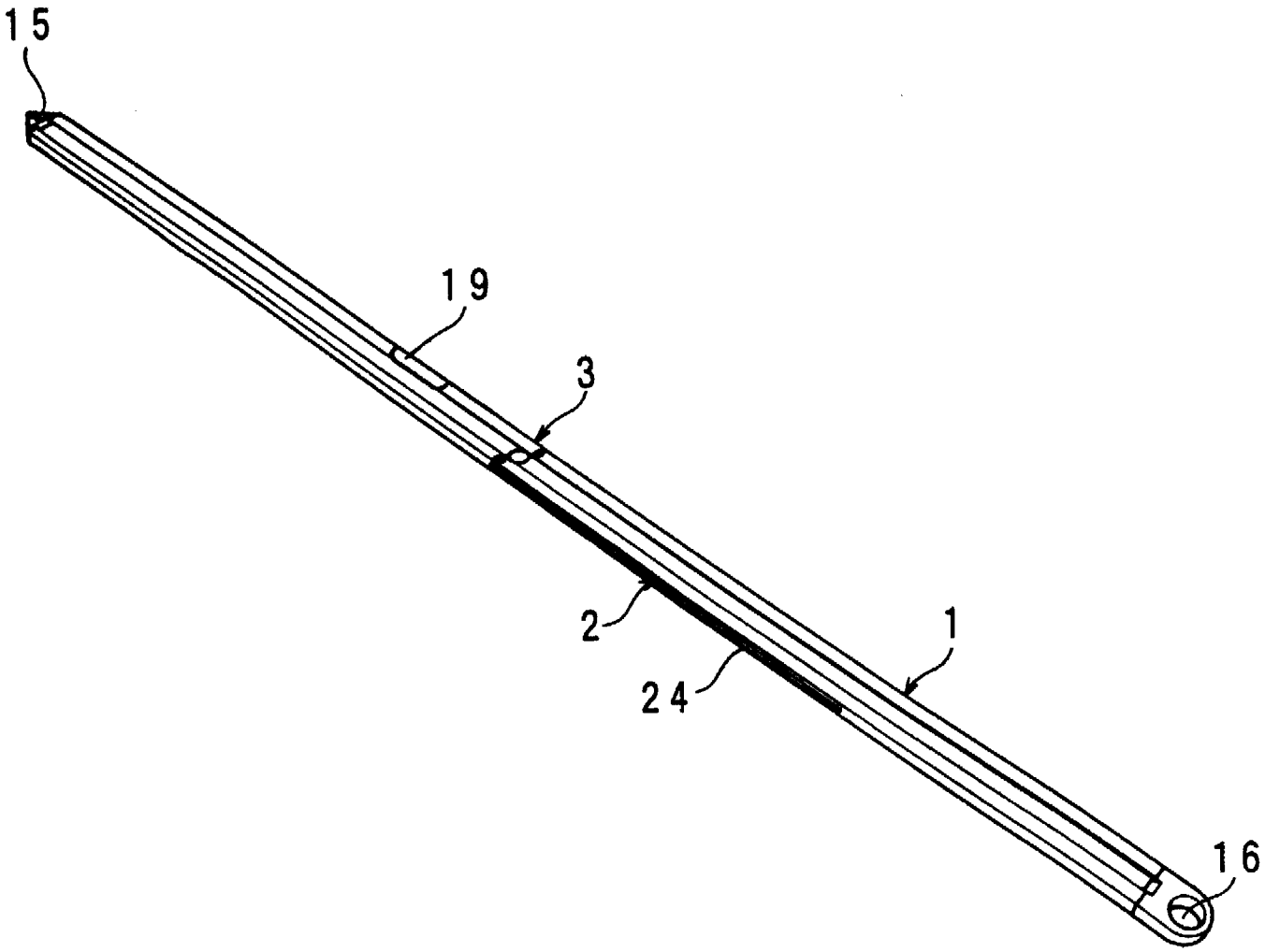
FIG. 4 is a perspective view of a second embodiment of a golf stance correcting device of the present invention, wherein the positioning indicator is received longitudinally within the direction indicator.

In the golf stance correcting device of the second embodiment, the adjuster 19 shown in FIGS. 4, 5 (here it works as a handhold) is pulled out and the the positioning indicator 2 is rotated out from the direction indicator 1. At a 90-degree rotated position, the shafts 10*a* come to fit into the setting grooves 9*c* to make the indicators 1 and 2 cross orthogonally as shown in FIGS. 6, 23.

Regarding the golf stance correcting device of the third embodiment, the state in which the positioning indicator 2 is longitudinally received within the direction indicator 1 is basically the same as in the second embodiment shown in FIG. 4, except that the rivets 10, 25 are positioned on a longitudinal line, not a diagonal line. This state is illustrated in FIG. 9. The adjuster 19 is pulled out and the positioning indicator 2 is rotated out from the direction indicator 1. At a 90-degree rotated position, the shafts 10*a* of the rivets 10 come to fit into the fitting grooves 8*b* to make the indicators 1 and 2 cross at right angles, as shown in FIGS. 10, 24.

Once the golf stance correcting device, of any one of these three embodiments, is rotatably set to make indicators 1 and 2 cross at right angles as previously described, the device is placed on a teeing ground or a practicing ground pointing the direction indicator 1 toward a pin on a putting green or any predetermined point (See FIGS. 22, 23, and 24). Next, with or without using a tee, a golf ball B is put immediately ahead or on the extension of the positioning indicator 2 or the needle 17. And a golfer stands parallel to the direction indicator 1, puts the left foot down near the left side of the positioning indicator 2 (in case of a right-handed golfer), and the right foot on the ground straddling over the indicator 2 and taking a proper stance. Then he can get in his correct golf stance with respect to the ball flying direction. The devices of the drawings are for right-handed golfers. A device for a left-handed golfer is naturally assembled reversely and used reversely.

A golf ball B can be placed on the ground in a position closely ahead of the tip of needle 17. Ball position indicating needle 17 may be extended or retracted from the tip of positioning indicator 2 to make an adjustment for proper club length (e.g. A long iron or driver requires the needle 17 to be further extended, whereas a short iron requires the needle to be more retracted.). Extendable needle 17 facilitates an accurate positioning of the ball for varied club lengths.

Impact to the tip of needle 17, by the golfer's attempt to hit the ball, will be absorbed by the flexibility of the tip resulting in a weakened impact to positioning indicator 2. The resulting weakened impact will prevent causing the device to fly away. The flexible tip of needle 17 assures a safe use of the device.

The golf stance correction device of the present invention is not only safe and practical in use, but also good in appearance, compact and easy to transport. Ball positioning indicator 2 is longitudinally superimposed on, or received within, ball flying direction indicator 1 for convenient storage of positioning indicator 2. Once the golf stance correction device is stored, as just described, the device can be easily placed in a golf bag together with golf clubs and carried.

What is claimed is:

1. A golf stance correcting device comprising:

a ball flying direction indicator having an upper plate, a lower plate, and side faces each of which has a longitudinal slit;

a ball positioning indicator pivotedly joined with said direction indicator between said upper and lower plates at a joined portion, said positioning indicator pivoting in and out of said direction indicator through said slit; and a setting mechanism, provided on said joined portion, for rotating said positioning indicator with respect to said direction indicator between a position wherein said positioning indicator fits longitudinally within said direction indicator and a position wherein said positioning indicator crosses said direction indicator at right angles, and setting the indicators at said positions.

2. A golf stance correcting device according to claim 1, wherein said setting mechanism comprises:

an elastic coupler in a middle portion of said positioning indicator, said elastic coupler having a shaft hole in a center portion and setting grooves on both sides thereof, said grooves being disposed at an angle of 45 degrees about said shaft hole from both a longitudinal direction and a lateral direction;

a central rivet in said shaft hole; and rivets fixed in said direction indicator penetrating said upper and lower plates, said rivets being disposed on a diagonal line between which said central rivet is provided, wherein said rivets are selectively fitted into one of said grooves on each of said sides.

3. A golf stance correcting device according to claim 2, further comprising a curved sliding route between said grooves on each of said sides.

4. A golf stance correcting device according to claim 3, wherein said curved sliding route has a first curvature near one of said grooves which provides said position wherein said positioning indicator fits longitudinally within said direction indicator, said first curvature being larger than a second curvature near another of said grooves which provides said position wherein said positioning indicator crosses said direction indicator at right angles.

5. A golf stance correcting device according to claim 3, further comprising a protrusion on a boundary between said sliding route and one of said grooves which provides said position wherein said positioning indicator fits longitudinally within said direction indicator.

6. A golf stance correcting device according to claim 3, further comprising a space between said shaft hole and each of said setting grooves.

7. A golf stance correcting device according to claim 1, wherein said setting mechanism comprises:

an elastic coupler in a middle portion of said positioning indicator, said elastic coupler having a shaft hole in a center portion and an indentation on each side thereof, said indentation having setting grooves therein one of which is disposed in a longitudinal direction from said shaft hole and another of which is disposed in a lateral direction from said shaft hole;

a central rivet in said shaft hole; and rivets fixed in said direction indicator penetrating said upper and lower plates, said rivets being disposed in a longitudinal direction between which said central rivet is provided, wherein said rivets are selectively fitted into one of said grooves in each of said indentations.

8. A golf stance correcting device according to claim 7, wherein at least one of said setting grooves is partly defined by an elastic pressing member and provided with a port, and a width of said port is smaller than the diameter of said rivet.

9. A golf stance correcting device according to claim 8, wherein said elastic pressing piece partly defining said groove in said lateral direction has a stronger elastic force than said elastic pressing piece partly defining said groove in said longitudinal direction.

10. A golf stance correcting device according to claim 8, wherein a sliding route is provided between said grooves in each of said indentations.

11. A golf stance correcting device according to claim 1, further comprising an extendable ball position indicating needle on a tip of said positioning indicator.

12. A golf stance correcting device according to claim 11, wherein said needle is made of flexible material.

13. A golf stance correcting device according to claim 1, further comprising an arrow at a tip of said direction indicator and a penetrating hole near a rear end of said direction indicator.

* * * * *